US005878466A

United States Patent [19]

Iten

[11] Patent Number: 5,878,466

[45] Date of Patent: Mar. 9, 1999

[54] BUCKLE

[75] Inventor: Roland Alexander Karlheinz Iten, Grancy, Switzerland

[73] Assignee: Bally Schuhfabriken AG, Schoenenwerd, Switzerland

[21] Appl. No.: 75,607

[22] Filed: May 11, 1998

[30] Foreign Application Priority Data

Mar. 20, 1998 [DE] Germany ..... 298 05 088 U

[51] Int. Cl.[6] ..... A44B 1/04

[52] U.S. Cl. ..... 24/178; 24/179

[58] Field of Search ..... 24/170, 174, 178, 24/179, 180, 181, 320; 2/311

[56] References Cited

U.S. PATENT DOCUMENTS

| | | | |
|---|---|---|---|
| 764,029 | 7/1904 | Askey | 24/178 |
| 788,194 | 4/1905 | Dudley | 24/178 |
| 844,184 | 2/1907 | Pijan | 24/178 |
| 1,057,714 | 4/1913 | Davis | 24/178 X |
| 2,876,516 | 3/1959 | Cummings | 24/178 X |
| 2,893,088 | 7/1959 | Harper et al. | 24/179 X |
| 3,488,814 | 1/1970 | Cormier | 24/178 |

*Primary Examiner*—Anthony Knight
*Assistant Examiner*—Robert J. Sandy
*Attorney, Agent, or Firm*—Michael J. Striker

[57] ABSTRACT

The buckle comprises a first buckle member and a second buckle member and a lever member connecting them. The first buckle member is e.g. attached to a first end of a belt, the second buckle member can be hooked into a second end of the belt. The lever member can be titled between two stable positions. In one position, the belt is held more tightly than in the second position.

10 Claims, 1 Drawing Sheet

BUCKLE

CROSS REFERENCE TO RELATED APPLICATIONS

This application claims the priority of the German utility model application 298 05 088.9, filed Mar. 20, 1998, the disclosure of which is incorporated herein by reference in its entirety.

BACKGROUND OF THE INVENTION

The invention relates to a buckle such it is e.g. used for pieces of closing, such as belts or shoes.

In practice, it should be possible to fasten and loosen such buckles easily.

BRIEF SUMMARY OF THE INVENTION

Hence, it is a general object of the invention to provide a buckle that can be fastened and loosened easily.

Now, in order to implement these and still further objects of the invention, which will become more readily apparent as the description proceeds, the buckle for connecting a tongue member and an attachment member is manifested by the features that it comprises a first buckle member adapted for being connected to said attachment member, a second buckle member adapted for being releasably attachable in a plurality of positions to said tongue member, and a lever member tiltably connected in a first titling axis to said first buckle member and tiltably connected in a second tilting axis to said second buckle member and being tiltable between at least two stable positions for varying a distance along a pulling direction between said tongue member and said attachment member.

In an other aspect of the invention, the buckle for connecting a tongue member and an attachment member comprises a first buckle member comprising means for being connected to said attachment member, a second buckle member comprising means for being releasably attachable in a plurality of positions to said tongue member, and a lever member tiltably connected in a first titling axis to said first buckle member and tiltably connected in a second tilting axis to said second buckle member and being tiltable between at least two stable positions for fastening and loosening said buckle.

By this design, the buckle can be fastened and loosened easily by operating the lever member between its two stable positions.

In order to stabilize the lever member its various positions, one of its two tilting axes can be designed to be displaceable transversely to the pulling direction, e.g. by being formed by one or two tilting pins engaging one or two elongate holes, respectively.

Preferably, the buckle is designed such that, upon exerting a pulling force, a torque is generated for pushing the lever member against the belt or tongue member.

The lever member preferably comprises an elongate body, wherein one of the tilting axes is arranged in an end section thereof and the other tilting axes is displaced laterally towards a lateral surface. Due to this design, one titling axis is displaced from the inside to the outside upon tilting the lever member, which leads to a reversal of the torque acting on the lever member caused by exerting a pulling force to tongue and attachment member.

The buckle can e.g. be caused by for belts or shoes.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 1:
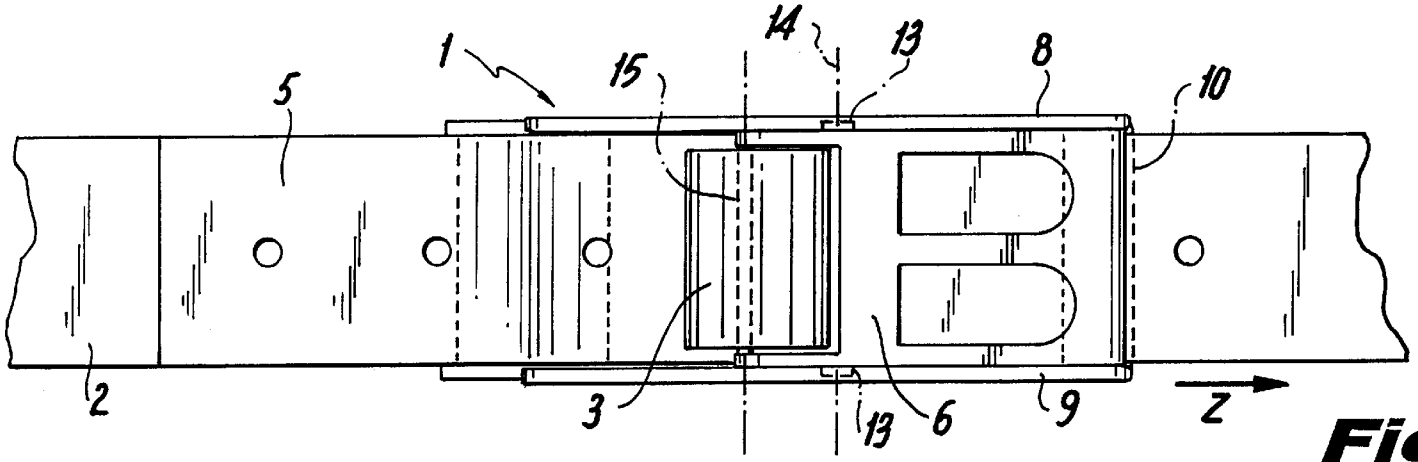
FIG. 1 is a top view of a preferred embodiment of the buckle.
Figure 2:
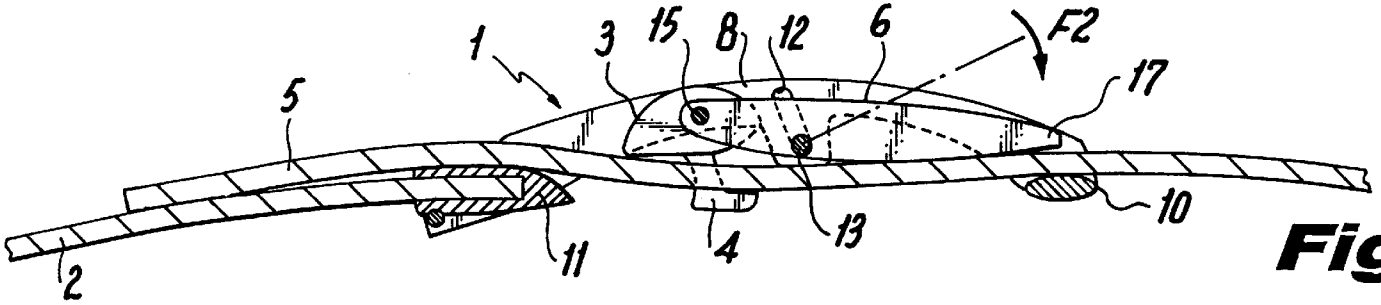
FIG. 2 is a schematic sectional view of the buckle of FIG. 1.

The basic design of a preferred embodiment of the buckle for a belt is shown in FIGS. 1 and 2. It comprises a first buckle member 1, which is connected to one end 2 of the belt, also designated as the belt's attachment member. It further comprises a second buckle member 3, which is releasably fastened by means of a buckle tongue 4 in a hole of the other end 5 of the belt, also designated the belt's tongue member. A lever member 6 is connects the first and second buckle members.

First buckle member 1 forms a square frame with two bent, lateral arms 8, 9 and two connecting bars 10, 11 extending between them. One of these bars 11 is fixedly connected to the first belt end 2.

An elongate hole 12 is arranged approximately in the middle of each arm 8, 9 and extends transversely to the pulling direction Z of the buckle. Elongate hole 12 is not extending exactly perpendicular to pulling direction Z but under a slight angle, such that its lower end lies somewhat further along pulling direction Z than its upper end.

A pin 13 is arranged on each side of the lever member 6. Each pin 13 engages the corresponding elongate hole 12 and is held therein in rotatable and displaceable manner. When seen from one side (FIG. 2), the pins 13 are not arranged on the longitudinal axis of lever member 6 but offset to one side. The pins 13 form a first titling axis 14 of lever member 6.

Second buckle member 3 is attached to lever member 6 at one end thereof and tiltable about a second tilting axis 15.

The second lever member 3 comprises, as mentioned, a buckle tongue 4 provided for engaging a hole of the second belt end 5.

The buckle works as follows:

During application, the second belt end 5 or tongue member extends above bars 10, 11 and below lever member 6 and second buckle member 3 and is hooked into buckle tongue 4. Lever member 6 can assume one of the stable positions shown in FIGS. 2 and 3. In the position of FIG. 2 it extends away from second buckle member 3 into pulling direction Z. The pins 13 are located at the lower ends of the elongate holes 12. Upon exerting a pulling force to the belt, a force acts on second titling axis 15 and causes a torque on lever member 6 into direction F2 because, when seen along pulling direction Z, first titling axis 14 is closer to the second belt end 5 than second tilting axis 15. Therefore, lever member 6 is pushed against the tongue member or second belt end 5, respectively, and is in a stable position.

Figure 3:
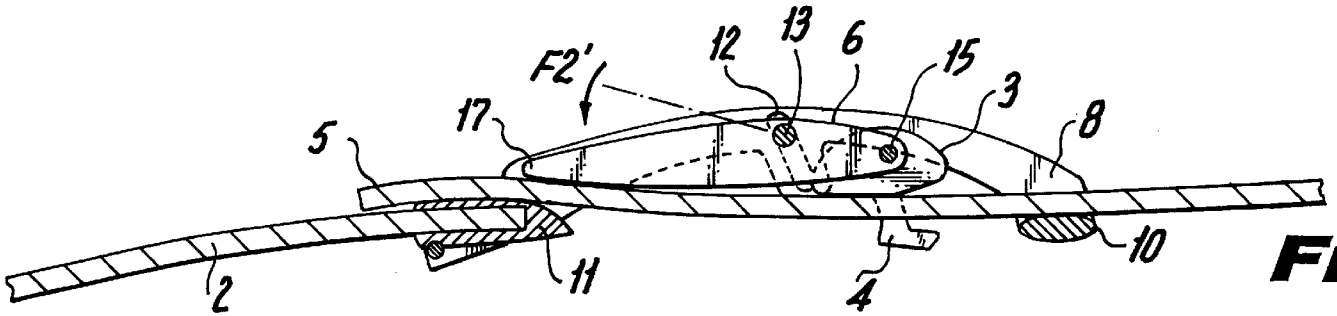
FIG. 3 is a schematic sectional view of the buckle of FIG. 2 in loosened position.

If the belt is to be loosened somewhat, lever member 6 is titled into the position shown in FIG. 3. For this purpose, it can be seized at its free end 17. Because the distance between the two tilting axes 14, 15 is smaller than the one between first titling axis 14 and free end 17, the user can profit from a lever action when moving lever member 6 between the positions shown in FIGS. 2 and 3.

When tilting lever member 6 from the position of FIG. 2 into the one of FIG. 3, second buckle member 3 is moved into pulling direction Z in respect to first buckle member 1. In this way, the belt is loosened somewhat but is still held securely. At the same time, the pins 13 move to the upper ends of the elongate holes and now lie, when seen into pulling direction Z, on the side of the buckle facing away from the belt. Hence, lever member 6 is stable in this position as well because a pulling force exerts a torque into direction F2' and therefore pushes lever member 6 against the belt.

In the embodiment of FIGS. 1–3 the buckle is used for closing a belt. It is, however, also possible to use the buckle e.g. for a shoe. For example, it can be used as a means for attaching a tongue extending over the shoe. Such a shoe can easily be loosened by titling lever member 6, e. g. while the user is sitting at a desk.

While there are shown and described presently preferred embodiments of the invention, it is to be distinctly understood that the invention is not limited thereto but may be otherwise variously embodied and practiced within the scope of the following claims.

I claim:

1. A buckle for connecting a tongue member and an attachment member comprising:

a first buckle member adapted for being connected to said attachment member, a second buckle member adapted for being releasably attachable in a plurality of positions to said tongue member, and a lever member tiltably connected in a first titling axis to said first buckle member and tiltably connected in a second tilting axis to said second buckle member and being tiltable between at least two stable positions for varying a distance along a pulling direction between said tongue member and said attachment member.

2. The buckle of claim 1 wherein at least one of the two tilting axes is displaceable in a direction transversal to said pulling direction.

3. The buckle of claim 2 wherein said at least one displaceable titling axis comprises a tilting pin engaging an elongate hole, which elongate hole is extending transversely to said pulling direction.

4. The buckle of claim 1 wherein said lever member is arranged between two arms of said first or second buckle member.

5. The buckle of claim 4 wherein each of said arms comprises an elongate hole extending transversely to said pulling direction and wherein said at least one displaceable titling axis comprises at least one tilting pin engaging said elongate holes.

6. The buckle of claim 1 wherein said titling axes are arranged such that in all said stable positions a force extending along said pulling direction generates a torque for pushing said tilting member against said tongue member.

7. The buckle of claim 1 wherein said lever member has an elongate body with two end sections and two lateral surfaces arranged between said end sections, wherein one of said tilting axes is arranged in one of said end sections and the other of said titling axes is arranged between said end sections and laterally displaced towards one of said lateral surfaces.

8. The buckle of claim 1 wherein said second buckle member comprises a tongue section for introducing into attachment holes of said tongue member.

9. The buckle of claim 1 wherein a distance between said two titling axes is smaller than a distance between said tilting axes and a free end of said titling member.

10. A buckle for connecting a tongue member and an attachment member comprising:

a first buckle member comprising means for being connected to said attachment member, a second buckle member comprising means for being releasably attachable in a plurality of positions to said tongue member, and a lever member tiltably connected in a first titling axis to said first buckle member and tiltably connected in a second tilting axis to said second buckle member and being tiltable between at least two stable positions for fastening and loosening said buckle.

* * * * *